US005954335A

United States Patent [19]

Moody

[11] Patent Number: 5,954,335

[45] Date of Patent: Sep. 21, 1999

[54] MULTIPLE PLAY TWENTY-ONE GAMES

[76] Inventor: Ernest W. Moody, 4381 Pebble Beach Dr., Longmont, Colo. 80503

[21] Appl. No.: 09/095,860

[22] Filed: Jun. 11, 1998

Related U.S. Application Data

[63] Continuation-in-part of application No. 08/495,952, Jun. 28, 1995, Pat. No. 5,531,448, application No. 08/755,174, Nov. 25, 1996, Pat. No. 5,732,950, application No. 08/900,965, Jul. 25, 1997, and application No. 09/083,531, May 22, 1998

[60] Provisional application No. 60/019,879, Jun. 17, 1996.

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS 5,154,429 10/1992 LeVasseur ..... 273/292

*Primary Examiner*—Benjamin H. Layno

*Attorney, Agent, or Firm*—John Edward Roethel

[57] ABSTRACT

A game of Twenty-One is described in which the player has the opportunity to play his first two cards multiple times. The player makes two or more wagers at the beginning of the hand. The player is dealt two cards and the dealer receives his two cards. The player uses the first two cards as his first hand with his first wager and plays these two cards as he would in the conventional manner of play of Twenty-One. The player may Double Down, split pairs and take Insurance if those options are available under the house rules of play. After the player has completed the play of his first hand, he uses his original two cards again as the first two cards of his second hand with his second wager. Again, the player plays his second hand as he would in the conventional manner of play of Twenty-One. If the player has made three or more wagers, the player repeats the play of each hand again using his first two cards with each additional wager. Once the player has completed the play of his hands, the dealer plays out his hand as he would in the conventional manner of play of Twenty-One. Each of the player's hands are compared to the dealer's hand and winning wagers are paid and losing wagers are collected.

2 Claims, 4 Drawing Sheets

MULTIPLE PLAY TWENTY-ONE GAMES

CROSS-REFERENCE TO RELATED APPLICATIONS

This application is a Continuation-in-Part of application Ser. No. 08/495,952, entitled "Poker-Style Card Game", filed Jun. 28, 1995, now U.S. Pat. No. 5,531,448; and is also based on and is a Continuation-in-Part of Provisional application Ser. No. 60/019,879, entitled "Electronic Video Poker Games", filed Jun. 17, 1996; and is also a Continuation-in-Part of application Ser. No. 08/755,174, entitled "Electronic Video Poker Games", filed Nov. 25, 1996, now U.S. Pat. No. 5,732,950; and is also a Continuation-in-Part of application Ser. No. 08/900,965, entitled "Electronic Video Poker Games", filed Jul. 25, 1997, now pending; and is also a Continuation-in-Part of application Ser. No. 09/083,531, entitled "Electronic Video Poker Games", filed May 22, 1998, now pending.

BACKGROUND OF THE INVENTION

This invention relates primarily to live or electronic video Twenty-One games, and more particularly to live or electronic video Twenty-One games that allow the player to play his first two cards of a Twenty-One game multiple times.

As played in most gaming casinos presently, conventional Twenty-One involves a game of chance between a dealer and one or more players. The object is for the player to achieve a numerical count of his hand closer to 21 than the final numerical count of the hand of the dealer; but if the numerical count of the player's hand goes over 21 then the player loses regardless of the final numerical count of the dealer's hand.

The conventional manner of play of Twenty-one is as follows: One or more standard decks of playing cards are used and each card counts its face value (with Jacks, Queens and Kings counting 10), except Aces which have a value of one or eleven as is most beneficial to the count of the hand. Each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has had the opportunity to take additional cards ("hits"), the dealer then receives his second card.

A player may draw additional cards in order to try and beat the count of the dealer's hand. If the player's numerical count exceeds 21, the player "busts." The player may "stand" on any numerical count of 21 or less. When a player busts, he loses his wager regardless of whether or not the dealer busts when the dealer draws additional cards to his hand.

After all of the players have taken hits or have stood on their hand, the dealer "stands" or "hits" based on pre-established rules for the game. Typically, if the dealer has less than 17, the dealer must take a hit. If the dealer has 17 or more, the dealer stands.

As the game of Twenty-One is played in most legalized gaming establishments, the conventional manner of play requires the dealer to take a hit whenever the dealer's hand is a "soft 17" numerical count. However in other gaming establishments, the dealer stands on a "soft 17" numerical count. The term "soft" means that the Ace is valued as a count of 11, instead of as a count of 1. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts, the player wins regardless of the numerical count of his hand. If neither the player nor the dealer has busted, the closest hand to a numerical count of 21, without going over, wins; tie hands are a "push."

There are other procedures that are included in the conventional manner of play of Twenty-One. One well-known procedure is "Doubling Down." If the player's first two cards have a combined value of 10 or 11, the player may "double down" on his hand. The player turns both of his cards face-up in front of him and makes a second wager up to, but not more than, the amount of the player's initial ante. The dealer deals to the player one additional card and the resulting three card hand establishes the numerical count for the player's hand. The most widely used "Doubling Down" rules permit the player to "double down" only on 10 or 11 counts. Other variations allow players to "double down" on 9, 10 or 11; only on 11; or on any two cards.

Another well-known procedure is "Splitting Pairs." If the player's first two cards are a pair, the player may "split" those cards into two separate hands. His original ante is applied to one of the hands and he makes an additional ante in the same amount for the other hand. The player receives a new second card for each of the split hands. Each of the split hands is then played separately and the player proceeds on each separate hand by standing or taking hits until he has achieved a hand count upon which he wishes to stand or until he busts. However, if the player splits Aces, then the player only receives one extra card on each Ace, unless the extra card is an Ace in which the case the player may again split the pair of Aces.

The player may "double down" on either or both of his split hands if he is eligible to do so under the "Doubling Down" rules. The player may split again if he pairs up on either or both of his split hands. In most gaming establishments, a player may also split his hand if both of his initial cards are ten count cards (Tens, Jacks, Queens or Kings). For example, a player can split if he receives a Ten and a Queen, or a Jack and a King, or any combination of ten count cards. Because a hand count of 20 is a good hand to have, most experienced Twenty-One players are reluctant to risk such a hand by "splitting".

Another well-known procedure is "Insurance." If the dealer's up card is an Ace, the player may make an additional "Insurance" bet. The insurance bets are made after each player receives his first two cards and the dealer reveals his up card (which must be an Ace for insurance to be available) and before any additional cards are dealt. When the dealer's up card is an Ace, each player can wager one-half of the amount of his original ante as insurance against the dealer having a Blackjack, i.e. a two-card 21 count (an Ace and a 10 count card such as a King, Queen, Jack or Ten). If the dealer has a Blackjack, the player loses on his original ante but wins two-to-one odds on his "insurance" bet. Also if the dealer has a Blackjack, that round of the game is over and all players lose except those who also have Blackjacks, who then tie or "push" with the dealer. If the dealer does not have a Blackjack, the player loses on his "insurance" bet and the round of the game continues.

Another conventional feature that is often offered in Twenty-One games is the "Surrender" option. If the player chooses to Surrender, the player receives back half of his initial wager and folds his hand. This option is usually only available after the player has received his first two cards and before the player has taken any hits on his hand.

As used in this disclosure and the accompanying claims, the terms "conventional Twenty-One" and "the conventional manner of play of Twenty-One" mean the game of Twenty-One as previously described and also including any of the known variations of the game of Twenty-One.

U.S. Pat. No. 5,154,429 (LeVasseur) discloses a Twenty-One game in which the player receives a single hand to play against multiple dealer's hands. The player makes one, two or three wagers depending upon how many dealer's hands the player wishes to play against. The player is dealt two cards and the dealer receives an original face up card. The player plays out his hand only once taking hits or standing as in conventional Twenty-One. Once the player has completed the play of his hand, the dealer then plays his hand out relative to the first wager made by the player. The outcome of this first play of the dealer's hand is determined relative to the player's hand. The dealer then discards all of his cards except the original face up card received by the dealer. The dealer then plays his hand out relative to the second wager made by the player. The player still uses his same first hand, but all the dealer's cards for his second hand are different except for the original face up card. Again the outcome of this second play of the dealer's hand is determined relative to the player's hand. Finally, a third dealer's hand is played in the same manner.

The method of play described in this patent has been commercially successful in gaming casinos and played under the mark MULTIPLE ACTION® Blackjack. But this method has the drawback that the player would have made three separate wagers and may receive a poor hand. The player must play a single hand with regard to all of his wagers. If the player during the play of this single hand exceeds a numerical hand count of 21 (the player busts), the player will have lost all three wagers regardless of the outcome of the play of the dealer's hand.

A disadvantage of conventional Twenty-One is that each round of the game consists of one player's hand against one dealer's hand. Once the player draws his cards and achieves a hand count total on which he wishes to "stand," the player has only a single opportunity to win or lose because the dealer is likewise playing only a single hand.

There is a need in Twenty-One for a modification in which the player has the opportunity to win more than once during each round of play and to take advantage when the player receives a good hand.

There is also a need for the gaming establishment to increase the amount of revenue generated by the game of Twenty-One in the same time period without simply increasing the size of the wagers made by the player. This can most easily be accomplished by increasing the number of hands that can be dealt and played in any given time period.

It is an object of the present invention to provide a method of play of the game of Twenty-One which increases the effective number of hands that can be played in the same amount of time.

It is a feature of the present invention to provide the player with multiple opportunities to play his initial two cards against a single hand of the dealer. Thus if the player receives a bad card or cards the first time he takes hits on his first two cards, the player has the opportunity to again take hits on his first two cards and possibly receive a better result.

It is an advantage of the present invention that the potential revenue to the gaming establishment can be increased because more hands per hour of Twenty-One can be played. Likewise the player is provided with multiple opportunities to win whenever the player achieves a good hand.

Other objects, features and advantages of the present invention will become apparent from a consideration of the following detailed description.

SUMMARY OF THE INVENTION

The method of the present invention involves a game of Twenty-One in which the player has the opportunity to play his first two cards multiple times. The player makes two or more wagers at the beginning of the hand. The player is dealt two cards and the dealer receives his two cards. The player uses the first two cards as his first hand with his first wager and plays these two cards as he would in the conventional manner of play of Twenty-One. The player may Double Down, split pairs, take Insurance and/or Surrender if those options are available under the house rules of play. After the player has completed the play of his first hand, he uses his original two cards again as the first two cards of his second hand with his second wager. Again, the player plays his second hand as he would in the conventional manner of play of Twenty-One. As with the first hand, with the second hand the player may Double Down, split pairs, take Insurance and/or Surrender if those options are available under the house rules of play. If the player has made three or more wagers, the player repeats the play of each hand again using his first two cards with each additional wager.

Once the player has completed the play of his hands, the dealer plays out his hand as he would in the conventional manner of play of Twenty-One. Each of the player's hands are compared to the dealer's hand and winning wagers are paid and losing wagers are collected.

DETAILED DESCRIPTION OF THE PREFERRED EMBODIMENTS

The method of the present invention is played either on a gaming table as a live table game using a dealer and one or more players or on an electronic gaming machine programmed to display to a single player the method of play.

If a gaming table is being used, one or more decks of standard playing cards are shuffled and each player makes two or more wagers at the beginning of each round of play. In the most preferred embodiment of play, each player makes three wagers—one for each hand that the player will be playing.

The dealer then deals two cards to each player and two cards to the dealer as the "dealer's hand". The dealer turns one of the cards of the dealer's hand face up. Alternatively, the dealer can deal only card initially as the dealer's hand and that card is turned face up. The dealer would then receive his second (and possibly other cards) after each player has completed the play of his hand.

Each player then takes his first two cards and plays these cards according to the conventional manner of play of Twenty-One with respect to the first wager made by the player. The player may stand on his first two cards. The player may take one or more hits on his first two cards in an attempt to reach a numerical count equal or close to 21 without going over 21. The player may Double Down on his first two cards if the Double Down option is available. The player may split pairs if the "splitting pairs" option is available. The player may take Insurance if the dealer's face up is an Ace. The player may "Surrender" of that option is available.

Once the player has played out his first two cards relative to his first wager, the player then plays out the same first two cards relative to his second wager, again according to the conventional manner of play of Twenty-One. After the player has completed the play of his hand relative to the second wager, the player again plays out the same first two cards relative to his third wager, again according to the conventional manner of play of Twenty-One.

The same procedure applies to each player in order around the gaming table. After all players have completed the play of their hands relative to all of their wagers, the dealer then plays out his hand according to the conventional manner of play of Twenty-One. All wagers are then settled up with the dealer paying winning hands and collecting losing hands according to the conventional manner of play of Twenty-One.

Figure 1:
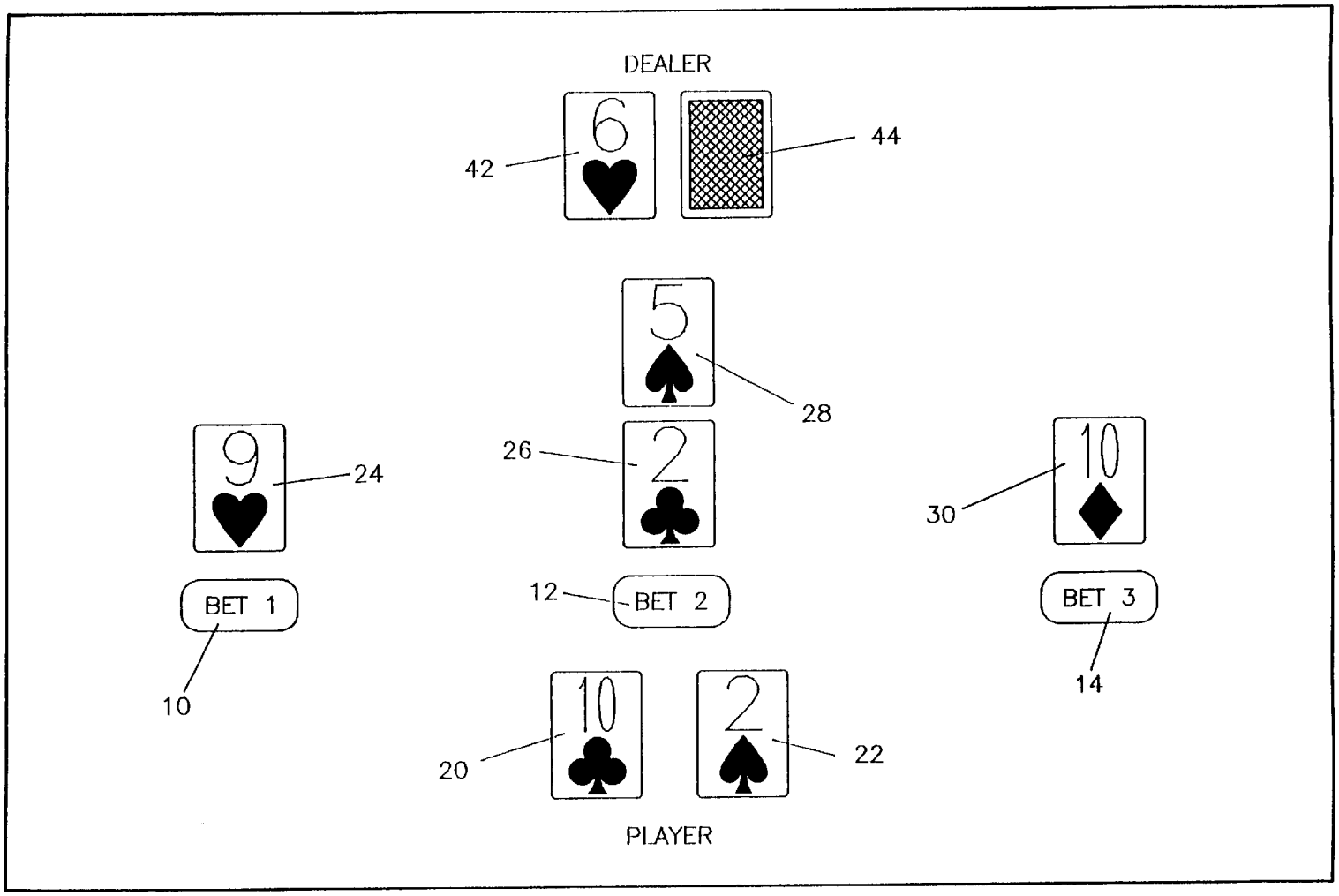
FIG. 1 shows the table layout of a first representative deal of the cards for the method of play of the present invention.

FIG. 1 shows a representative deal that could occur during the method of play of the present invention. The player initially makes three wagers in the appropriate betting locations provided on a table layout. "BET 1" is made at location 10, "BET 2" is made at location 12 and "BET 3" is made at location 14. The amount wagered at each location can be any amount; however, in the preferred embodiment, all three wagers will be the same amount, say $5.

The player is then dealt his first two cards, in this example, a Ten 20 and a Deuce 22. The dealer is dealt his first two cards—one face up and one face down. In this example, the dealer is dealt the Six♥ 42 and a face down card 44.

The player now plays his first two cards separately relatively to each wager. With regard to the "BET 1" wager 10, the player takes a hit and receives a Nine♥. This gives the player a numerical hand count relative to wager 10 of 21 and the player will stand. On the "BET 2" wager 12, the player first draws a Deuce and then takes another hit and receives the Five for a numerical hand count of 19 and the player stands. On the "BET 3" wager 14, the player draws a Ten♦ which gives the player a numerical hand count of 22 which busts the player and the player loses his wager 14.

The dealer then plays out his hand according to the conventional manner of play of Twenty-One. Depending on the numerical count of the final dealer's hand, the dealer collects losing wagers from the player and pays winning wagers to the player. If the dealer and player have the same final numerical hand count, the hand is a tie and the wagers are pushes.

Figure 2:
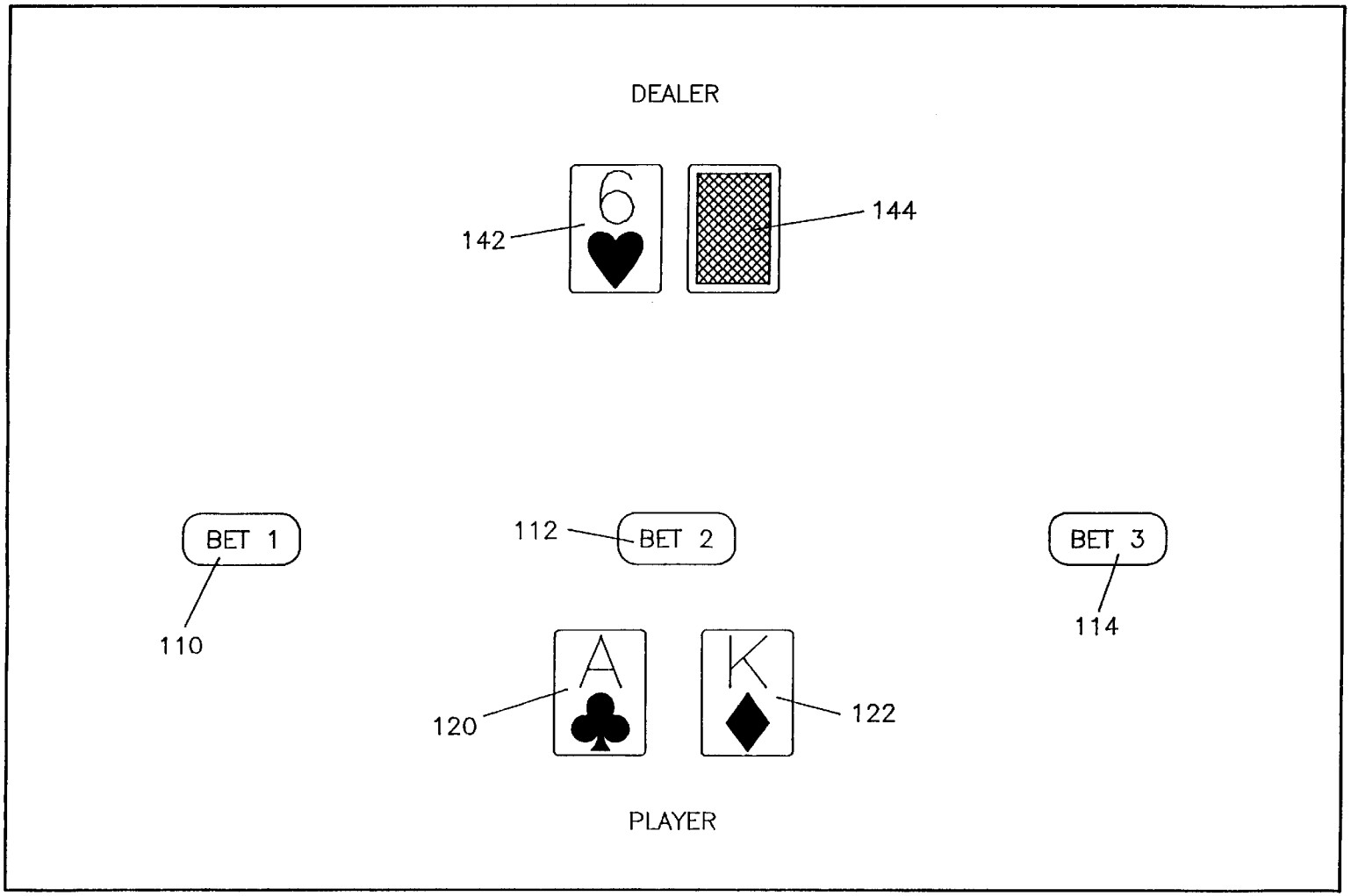
FIG. 2 shows the table layout of a second representative deal of the cards for the method of play of the present invention.

FIG. 2 shows another representative deal that could occur during the method of play of the present invention. The player initially makes three wagers in the appropriate betting locations provided on a table layout. "BET 1" is made at location 110, "BET 2" is made at location 112 and "BET 3" is made at location 114. The player is then dealt his first two cards, in this example, an Ace 120 and a King♦ 122. The player has a two card numerical hand count of 21 which is a Blackjack. The dealer is dealt his first two cards—one face up and one face down. In this example, the dealer is dealt the Six♥ 142 and a face down card 144.

The player may now play his first two cards separately relatively to each wager. However, it would be foolish for the player to do anything other than stand on all three wagers since a Blackjack pays three-to-two odds on each wager. Since the dealer cannot have a Blackjack, the player would win all three wagers and would be paid three-to-two odds on each of his three wagers.

Figure 3:
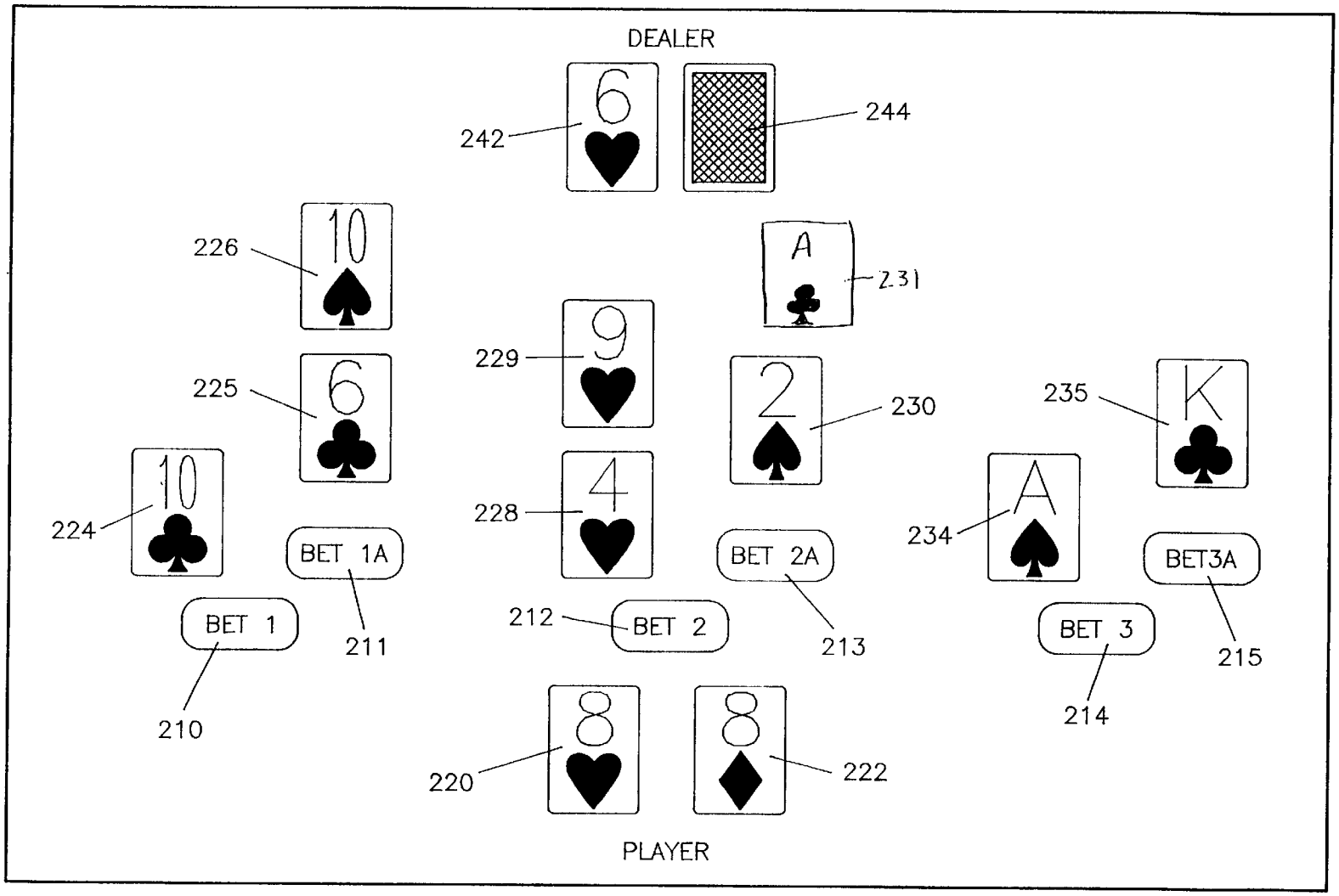
FIG. 3 shows the table layout of a third representative deal of the cards for the method of play of the present invention.

FIG. 3 shows another representative deal that could occur during the method of play of the present invention. The player initially makes three wagers in the appropriate betting locations provided on a table layout. "BET 1" is made at location 210, "BET 2" is made at location 212 and "BET 3" is made at location 214.

The player is then dealt his first two cards, in this example, an Eight♥ 220 and an Eight♦ 222. The dealer is dealt his first two cards—one face up and one face down. In this example, the dealer is dealt the Six♥ 242 and a face down card 244.

In this example, the player has been dealt a pair of Eights and the player may split this pair which is permitted according to the conventional manner of play of Twenty-One. In fact according to accepted player procedures for playing Twenty-One, a player should always split a pair of Eights.

In order to split a pair, the player makes an additional second wager in the same amount as his first wager. As shown in FIG. 3, the player has made an additional "BET 1A" wager 211 coupled with his "BET 1" wager 210. The player makes another additional "BET 2A" wager 213 coupled with his "BET 2" wager 212. And the player also makes an additional "BET 3A" wager 215 coupled with his "BET 3" wager 214.

The player now splits his two Eights relative to the "BET 1" wager 210 and the "BET 1A" wager 211. The Eight♥ is played with regard to the "BET 1" wager 210 and the player takes a hit and receives the Ten 224 which gives the player a numerical hand count of 18 and the player now stands.

The Eight♦ is played with regard to the "BET 1A" wager 211 and the player takes a hit and receives the Six 225 and then takes another hit and receives the Ten 226 which gives the player a numerical hand count of 24 and the player busts and loses his "BET 1A" wager 211.

The player now again splits his two Eights relative to the "Bet 22" wager 212 and the "BET 2A" wager 213. The Eight♥ is played with regard to the "BET 2" wager 212 and the player takes a hit and receives the Four♥ 228 and the player takes a second hit and receives the 9♥ 229 which gives the player a numerical hand count of 21 and the player now stands.

The Eight♦ is played with regard to the "BET 2A" wager 213 and the player takes a hit and receives the Two 230. This gives the player a numerical hand count of 10 relative to the "BET 2A" wager 213. The player can then take another hit and the player receives one more card which turns out to be the Ace 231. This gives the player a numerical hand count of 21.

The player now once again splits his two Eights relative to the "BET 3" wager 214 and the "BET 3A" wager 215. The Eight♥ is played with regard to the "BET 3" wager 214 and the player takes a hit and receives the Ace 234 which gives the player a numerical hand count of 19 and the player now stands.

The Eight♦ is played with regard to the "BET 3A" wager 215 and the player takes a hit and receives the King 235.

This gives the player a numerical hand count of 18 and the player again stands on that count.

The dealer then plays out his hand according to the conventional manner of play of Twenty-One. Depending on the numerical count of the final dealer's hand, the dealer collects losing wagers from the player and pays winning wagers to the player. If the dealer and player have the same final numerical hand count, the hand is a tie and the wagers are pushes.

Figure 4:
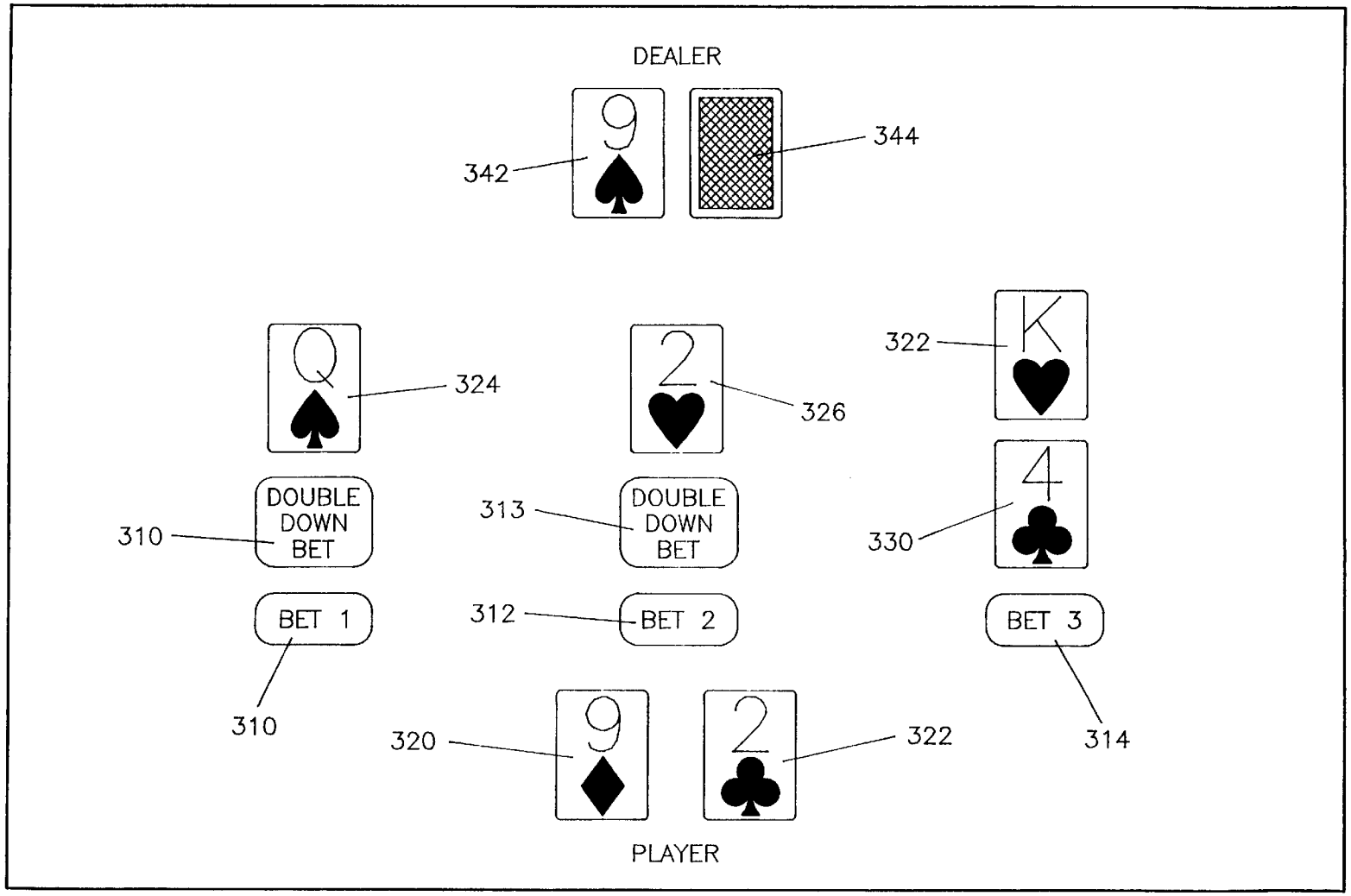
FIG. 4 shows the table layout of a fourth representative deal of the cards for the method of play of the present invention.

FIG. 4 shows another representative deal that could occur during the method of play of the present invention and describes how the method of play can be practiced using the Double Down feature. The player initially makes three wagers in the appropriate betting locations provided on a table layout. "BET 1" is made at location 310, "BET 2" is made at location 312 and "BET 3" is made at location 314.

The player is then dealt his first two cards, in this example, a Nine♦ 320 and a Deuce 322. The dealer is dealt his first two cards—one face up and one face down. In this example, the dealer is dealt the Nine 342 and a face down card 344. The player's first two cards combine for a numerical hand count of 11.

The player now has the option of doubling down on each of his three wagers which is available according to the conventional manner of play of Twenty-One. If the player elects to double down, the player must make a second wager equal to or less than the amount of his initial wager.

In this example, the player has elected to double down on the "BET 1" wager 310 and the player makes a second wager at location 311. According to the conventional manner of play of Twenty-One, on a double down wager the player only receives one more card. In this example, the player receives a Queen 324. This gives the player a numerical hand count relative to wager 310 and 311 of 21. On the "BET 2" wager 312, the player also has elected to double down by making a second wager 313 and the player receives only one card which turns out to be the Deuce♥ 326 for a numerical hand count of 13.

On the "BET 3" wager 314, the player elects not to double down and simply plays out this wager by taking hits. In this example, the player receives a Four 330 and then takes a second hit and receives a King♥ 332 which gives the player a numerical hand count of 25. This is a bust hand and the player loses his wager 314.

The dealer then plays out his hand according to the conventional manner of play of Twenty-One. Depending on the numerical count of the final dealer's hand, the dealer collects losing wagers from the player and pays winning wagers to the player. If the dealer and player have the same final numerical hand count, the hand is a tie and the wagers are pushes.

The method of play of the present invention can also be displayed in a single player electronic video gaming machine. The electronic video gaming machine version of the present invention would be played in the same manner as described above with regard to the live table game version.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game based on the conventional manner of play of Twenty-One comprising:

a) a player making at least a first wager and a second wager;

b) dealing an initial two cards to the player;

c) dealing at least a face up card to the dealer comprising the dealer's hand;

d) with respect to the player's first wager, the player playing out the initial two cards to form a player's first hand according to the conventional manner of play of Twenty-One;

e) with respect to each other wager, the player again using the initial two cards and playing out the initial two cards to form another player's hand according to the conventional manner of play of Twenty-One, wherein the number of player's hands corresponds to the number of wagers placed;

f) the dealer playing out the dealer's hand a single time only to form only one dealer's hand according to the conventional manner of play of Twenty-One;

g) with respect to the first wager, comparing the player's first hand with the dealer's hand, and with respect to each other wager, comparing the player's another hand with the dealer's hand; and h) accounting for winning, losing and tieing hands according to the conventional manner of play of Twenty-One.

2. A method of playing a card game based on the conventional manner of play of Twenty-One comprising:

a) a player making at least a first wager, a second wager and a third wager;

b) dealing an initial two cards to the player;

c) dealing at least a face up card to the dealer comprising the dealer's hand;

d) with respect to the player's first wager, the player playing out the initial two cards to form a player's first hand according to the conventional manner of play of Twenty-One;

e) with respect to the second wager, the player again using the initial two cards and playing out the initial two cards to form a player's second hand according to the conventional manner of play of Twenty-One;

f) with respect to the third wager, the player again using the initial two cards and playing out the initial two cards to form a player's third hand according to the conventional manner of play of Twenty-One;

g) the dealer playing out the dealer's hand a single time only to form only one dealer's hand according to the conventional manner of play of Twenty-One; and h) with respect to the first wager, comparing the player's first hand with the dealer's hand, with respect to the second wager, comparing the player's second hand with the dealer's hand, with respect to the third wager, comparing the player's third hand with the dealer's hand; and i) accounting for winning, losing and tieing hands according to the conventional manner of play of Twenty-One.

* * * * *